US008187118B2

(12) United States Patent
Matsunaga et al.

(10) Patent No.: US 8,187,118 B2
(45) **Date of Patent: *May 29, 2012**

(54) GOLF CLUB HEAD

(75) Inventors: Hideo Matsunaga, Chichibu (JP); Hiroshi Takahashi, Chichibu (JP); Makoto Kubota, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/904,776

(22) Filed: Oct. 14, 2010

(65) Prior Publication Data

US 2011/0028243 A1 Feb. 3, 2011

Related U.S. Application Data

(63) Continuation of application No. 12/178,069, filed on Jul. 23, 2008, now Pat. No. 7,935,003.

(30) Foreign Application Priority Data

Sep. 26, 2007 (JP) ..... 2007-249184

(51) Int. Cl.
*A63B 53/04* (2006.01)

(52) U.S. Cl. ..... 473/342; 473/345

(58) Field of Classification Search ..... 473/324–350
See application file for complete search history.

(56) References Cited

U.S. PATENT DOCUMENTS 5,405,137 A 4/1995 Vincent et al.
5,586,947 A 12/1996 Hutin
5,697,855 A 12/1997 Aizawa
6,309,310 B1 10/2001 Shira
6,478,693 B2 * 11/2002 Matsunaga et al. ..... 473/345
6,508,722 B1 1/2003 McCabe et al.
6,575,845 B2 6/2003 Galloway et al.
6,582,321 B2 6/2003 Galloway et al.
6,582,323 B2 6/2003 Soracco et al.
6,602,149 B1 8/2003 Jacobson
6,605,007 B1 8/2003 Bissonnette et al.
6,638,182 B2 10/2003 Kosmatka
6,652,391 B1 11/2003 Kubica et al.
6,800,038 B2 10/2004 Willett et al.
6,824,475 B2 11/2004 Burnett et al.
7,018,303 B2 * 3/2006 Yamamoto ..... 473/329
7,018,305 B2 3/2006 Sugimoto
7,066,832 B2 6/2006 Willett et al.

(Continued)

FOREIGN PATENT DOCUMENTS

JP 04212387 A * 8/1992

(Continued)

*Primary Examiner* — Alvin Hunter

(74) *Attorney, Agent, or Firm* — Sughrue Mion, PLLC

(57) ABSTRACT

A golf club head includes a face member having a ball-striking face and an oval thick portion positioned in a central portion of the ball-striking face. The oval thick portion has an oval shape having recesses formed by recessing both sides in a major axis direction in an arc-shaped fashion. The recesses are directed to a toe-side upper portion and a heel-side lower portion. The thickness of the thick portion becomes thickest at a central portion and is gradually reduced from the central portion towards the periphery. The face member is formed such that a portion outside the thick portion is thinner than the thick portion. An occupancy rate of the oval thick portion in the ball-striking face is in a range of 25 to 45%.

17 Claims, 5 Drawing Sheets

U.S. PATENT DOCUMENTS

| | | | | |
|---|---|---|---|---|
| 7,144,337 | B2 | 12/2006 | Hirano | |
| 7,169,062 | B2 | 1/2007 | Chen | |
| 7,220,190 | B2 | 5/2007 | Hirano | |
| 7,338,388 | B2 | 3/2008 | Schweigert et al. | |
| 7,559,853 | B2 | 7/2009 | Hirano | |
| 7,563,175 | B2 | 7/2009 | Nishitani et al. | |
| 7,618,331 | B2 * | 11/2009 | Hirano | 473/329 |
| 7,686,706 | B2 * | 3/2010 | Matsunaga et al. | 473/329 |
| 7,935,003 | B2 * | 5/2011 | Matsunaga et al. | 473/342 |
| 2007/0178991 | A1 | 8/2007 | Hou | |

FOREIGN PATENT DOCUMENTS

| | | | | |
|---|---|---|---|---|
| JP | 9-75485 | A | | 3/1997 |
| JP | 9-168613 | A | | 6/1997 |
| JP | 9-192273 | A | | 7/1997 |
| JP | 9-239074 | A | | 9/1997 |
| JP | 9-239075 | A | | 9/1997 |
| JP | 9-299518 | A | | 11/1997 |
| JP | 9-299519 | A | | 11/1997 |
| JP | 10-24130 | A | | 1/1998 |
| JP | 2000176058 | A | * | 6/2000 |
| JP | 2001-346916 | A | | 12/2001 |
| JP | 2002119624 | A | * | 4/2002 |
| JP | 2002126135 | A | * | 5/2002 |
| JP | 2002165905 | A | * | 6/2002 |
| JP | 2002-233596 | A | | 8/2002 |
| JP | 2002-239040 | A | | 8/2002 |
| JP | 2003-19233 | A | | 1/2003 |
| JP | 2003-52865 | A | | 2/2003 |
| JP | 2003-102879 | A | | 4/2003 |
| JP | 2003-126310 | A | | 5/2003 |
| JP | 2003-135630 | A | | 5/2003 |
| JP | 2005052400 | A | * | 3/2005 |
| JP | 2005-118418 | A | | 5/2005 |
| JP | 2005-124745 | A | | 5/2005 |
| JP | 2005-137794 | A | | 6/2005 |
| JP | 2005-143601 | A | | 6/2005 |
| JP | 2005-253973 | A | | 9/2005 |
| JP | 2005312954 | A | * | 11/2005 |

* cited by examiner

GOLF CLUB HEAD

CROSS-REFERENCE TO RELATED APPLICATIONS

This is a continuation of application Ser. No. 12/178,069, filed Jul. 23, 2008, which is based upon and claims the benefit of priority from Japanese Patent Application No. 2007-249184, filed Sep. 26, 2007, the entire contents of which are incorporated herein by reference.

BACKGROUND OF THE INVENTION

The present invention relates to a head of a wood club and more particularly to a golf club head which reduces the loss of flying distance even at the time of off-center hitting or when a ball is hit off the center of the striking face of the golf club.

In heads of most of wood clubs marketed recently, at least a face portion is made of a metallic material, and the thickness of the face portion has had to be thicker in order to maintain a strength which is good enough to resist an impact produced when a ball is hit thereby. Heads have continued to be made larger in size, resulting in a regulation that the volume of a head must not be larger than 460 $cm^3$ with a permissible production error of 10 $cm^3$, and hence, heads of most of the current drivers are enlarged as close to the upper limit of 460 $cm^3$ as possible. When the head size is increased, the sweet spot is also enlarged, and the peripheral weight distribution is emphasized, whereby horizontal and vertical inertia moments are increased, and the occurrence of a hitting error such as an off-center hitting can be reduced. However, when the head size is increased to increase, in turn, the weight of the head, the head speed is reduced, and this sometimes results in a reduction in flying distance of a ball hit. To cope with this, a means has now been adopted to realize a head construction in which titanium (or an alloy thereof, hereinafter, both being referred to as "titanium") which has a small specific weight and large strength, is used to form the whole of a head or a composite head is made of carbon and titanium.

In addition, not only golf clubs in which the head size is enlarged but also golf clubs with highly restitutive heads in which the restitution coefficient of the head is increased have been developed. As to the highly restitutive heads, the rule now stipulates that golf clubs with heads having a restitution coefficient of 0.830 or more are not allowed to be used in official tournaments from 2008 onward. Up until now, thick face materials have been aggressively used to increase the restitution coefficient in parallel with the adoption of those enlarged heads. However, even with those highly restitutive heads, when a ball is hit at a face portion other than the sweet spot or is hit at an off-center face portion, no spring effect can be expected, and the flying distance tends to be reduced drastically.

As a conventional example in which the spring effect is aimed by imparting springing properties to the whole of a face, there has been known a technique in which the thickness of a central portion including a sweet spot of a portion which makes up a face is formed to have a sufficient strength which can resist impact produced when the portion in question hits a ball, and the thickness of the periphery of the central portion is formed thinner than the central portion to impart springing properties to the whole of the face (refer to JP-A-9-192273 (page 2, FIG. 1).

With the golf club head described in JP-A-9-192273, although the flying distance of a ball is increased due to the springing properties of the whole of the face functioning properly when the ball is hit at the sweet spot, the flying distance of the ball is reduced remarkably when the ball is hit at the off-center portion on the face.

SUMMARY OF THE INVENTION

An object of the invention is to provide a golf club head which has a restitution coefficient which falls within a range which meets the regulation and prevents the reduction in initial speed of a ball even when the ball is hit at an off-center portion of a face thereof, so as to avoid as much as possible a reduction in flying distance of the ball hit.

The invention provides a golf club head including: a face member made of a metal material. The face member includes a ball-striking face, and an oval thick portion positioned in a central portion of the ball-striking face. The oval thick portion has an oval shape viewed in a direction crossing the ball-striking face, the oval shape having recesses formed by recessing both sides in a major axis direction in an arc-shaped fashion. The oval thick portion is formed on the face member such that the recesses are directed to a toe-side upper portion and a heel-side lower portion, respectively. The oval thick portion has a thickness that becomes thickest at a central portion of the oval thick portion and is gradually reduced from the central portion towards a periphery of the oval thick portion. The face member is formed such that a portion which lies outside the thick portion is thinner than the oval thick portion. An occupancy rate of the oval thick portion in the ball-striking face is in a range of 25 to 45%.

DETAILED DESCRIPTION OF THE PREFERRED EMBODIMENTS

Hereinafter, an embodiment of the invention will be described by reference to the drawings.

Figure 1:
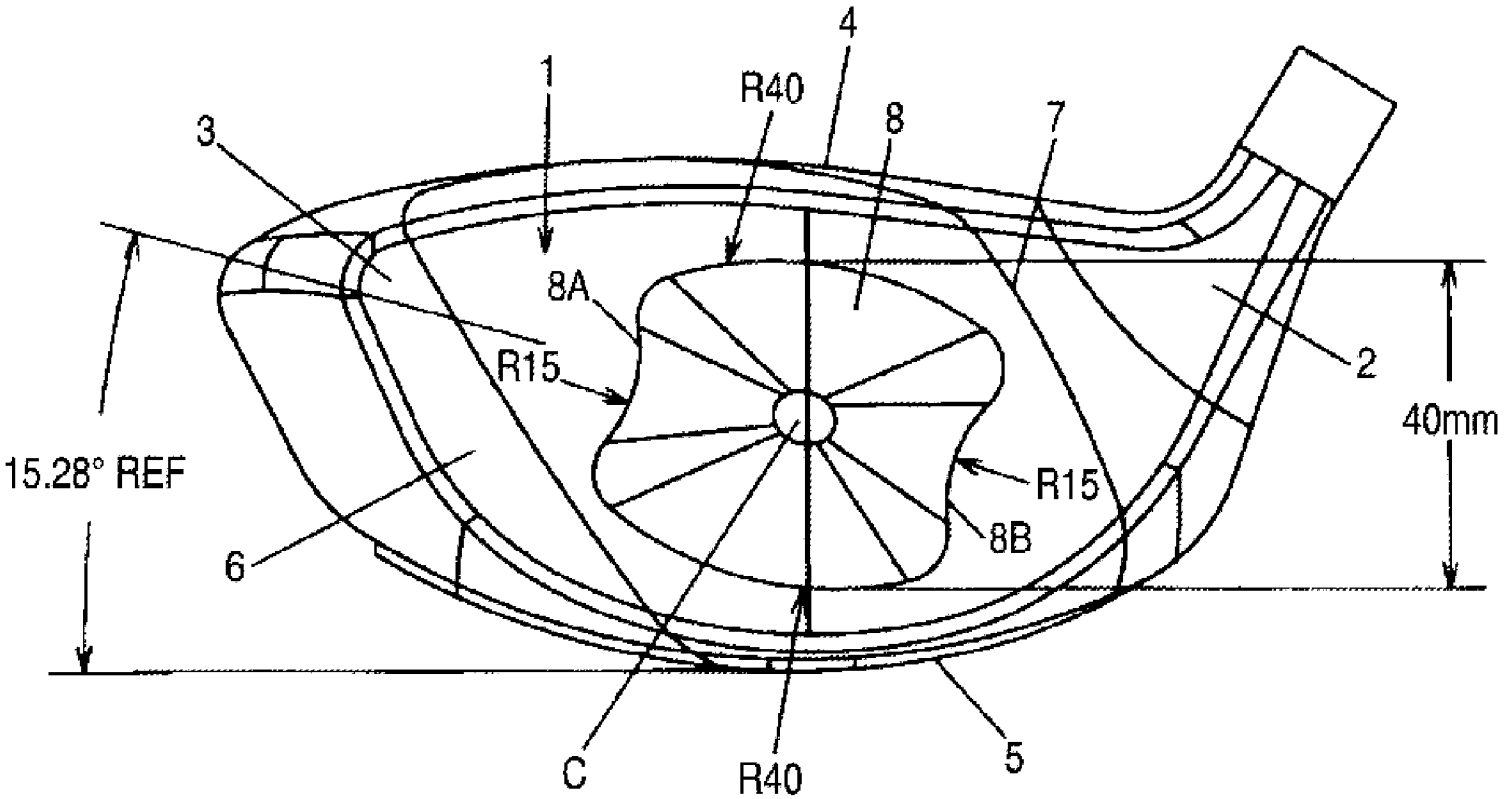
FIG. 1 is a front view of a face of a head.

FIG. 1 shows a front view of a head of a club called a driver which is a wood club, and a portion which resides in an interior of the head is also indicated by a solid line (and hence, the portion does not appear on an actual front view of a face). A face member 1 of this head is made up of a main body portion 6 which is made of titanium and which lies close to a heel 2 and a toe 3 and an insert portion 7 which is made of titanium and which is integrated into the main body portion 6 in such a manner as to expand between part of a crown 4 and part of a sole 5, and the insert portion 7 is formed into a shape which resembles a parallelogram which is tilted towards the toe 3. This insert portion 7 is welded to a main body of the head, and a surface treatment is applied thereto, whereby the insert portion 7 does not appear clearly on a front external appearance of a face of the face member 1. In addition, a geometrical central portion C of a ball striking face of the face member 1 exists on the insert portion 7, and, assuming an oval (having a major axis of 60 mm and a minor axis of 40 mm) whose center is positioned in this central portion C, a thick portion 8 having recesses 8A, 8B which are formed by recessing both sides in the major axis direction in an arc-shaped fashion is formed on a rear surface of the insert portion 7. The thickness of a central portion of the thick portion 8 is made to be 3.7 mm (in the range of 3.0 to 4.0 mm), and the thickness is made to be gradually reduced towards the periphery of the thick portion 8 (2.7 to 2.5 mm at an outermost circumference), the thickness of a face portion outside the thick portion 8 being made to be 2.5 mm or less (1.5 to 2.8 mm, preferably, 1.8 to 2.5 mm). The central portion C denotes an area including a sweet spot whose diameter is substantially in the range of 3 to 5 mm.

Although the inclination of the major axis of the thick portion 8 is made to be 15.28° from a horizontal line which is tangent to the sole 5, any angle will do, provided that it falls within a range of 10° to 30°. Since it is statistically known that scattered striking points of amateur golfers tend to be collected in an upper portion in the toe 3 and a lower portion in the heel 2, it is important that the recesses 8A, 8B of the thick portion 8 are directed, respectively, to the upper portion on the side of the toe 3 and the lower portion on the side of the heel 2, and the angle at which the recesses are directed is made to be represented by the inclination of the major axis of the oval which is set to fall in the range of 10° to 30°. Areas to which the recesses 8A, 8B are directed may occupy 60% or more or preferably 70% or more of the face which excludes the thick portion 8.

Furthermore, although a radius of curvature of the recesses 8A, 8B of the thick portion 8 is made to be R15 (mm), the radius of curvature can be made to fall within a range of R12 to R25. In addition, although a radius of curvature of arcs of crown 4 and sole 5 sides of the thick portion 8 is made to be R40, the radius of curvature can be made to fall within a range of R35 to R60. Furthermore, an occupancy rate of the thick portion 8 in the face of the face member 1 is preferably made to fall within a range of 25 to 45%, and a ratio of the major axis (the length between the recesses 8A, 8B) to the minor axis is preferably made to fall within a range of 5:4 to 5:6.

Figure 2:
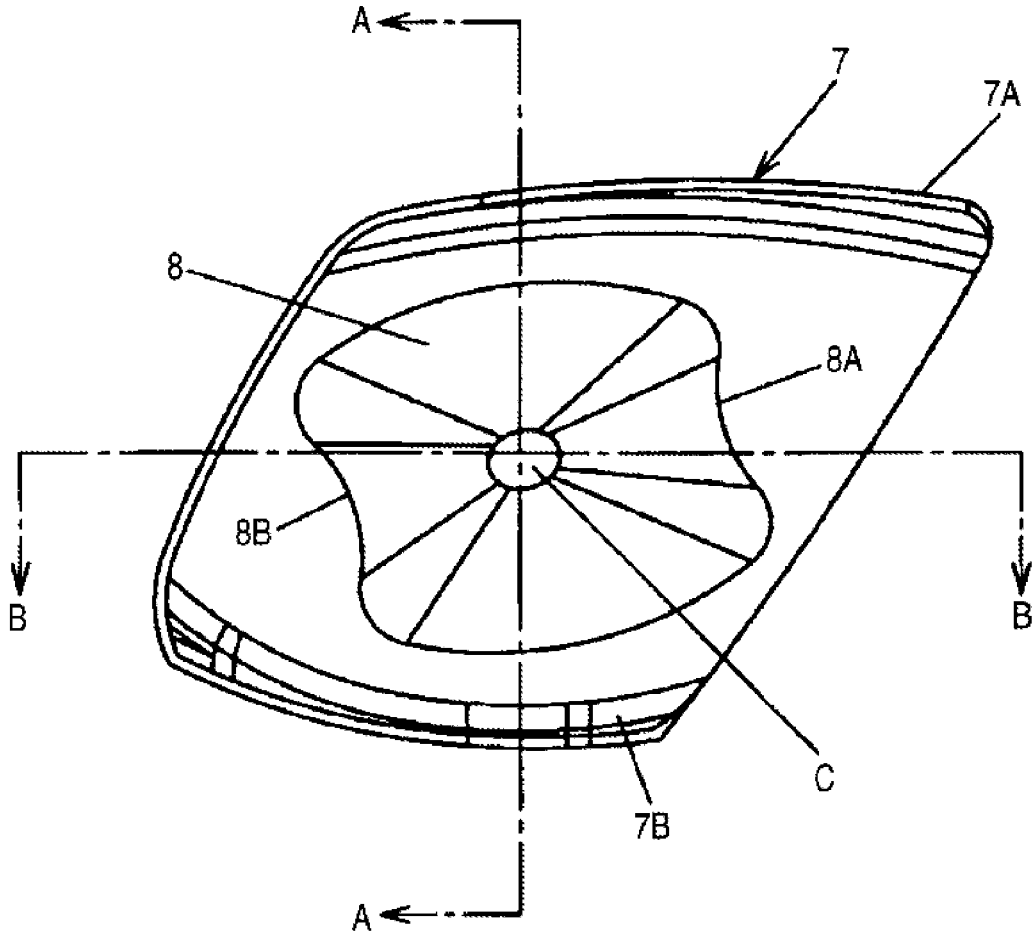
FIG. 2 is a rear view of an insert portion.

FIG. 2 is a rear view of the insert portion 7. The insert portion 7 is such as to make up a main part of the face member 1 and can be made of titanium using either of forging and casting approaches. An upper edge 7A of the insert portion 7 is bent inwards so as to make up part of the crown 4, and a lower edge 7B is also bent inwards so as to make up part of the sole 5. The periphery of the insert portion 7 is welded securely to the main body portion of the head which is made of a titanium alloy.

Figure 3:
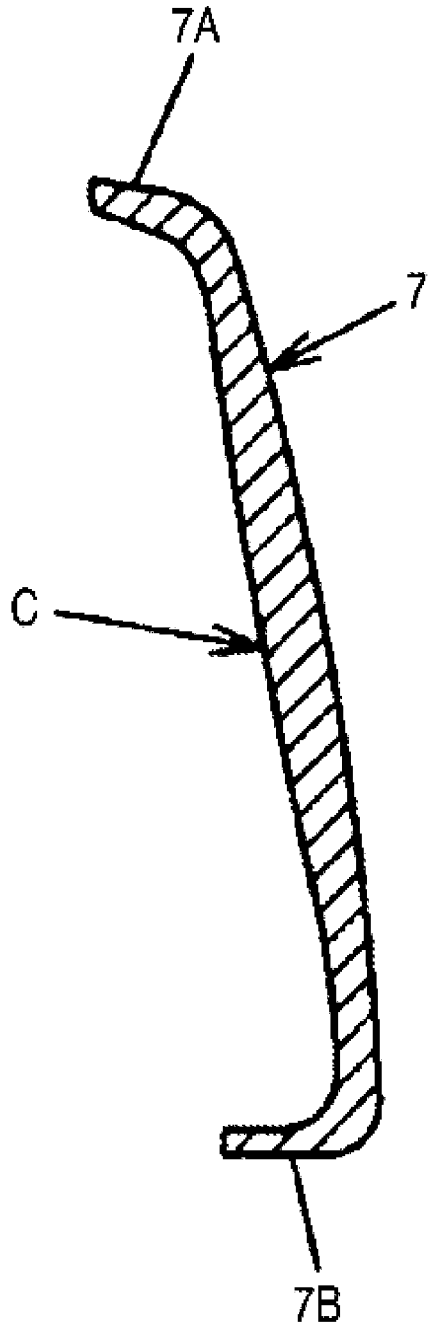
FIG. 3 is a sectional view taken along the line A-A in FIG. 2.
Figure 4:
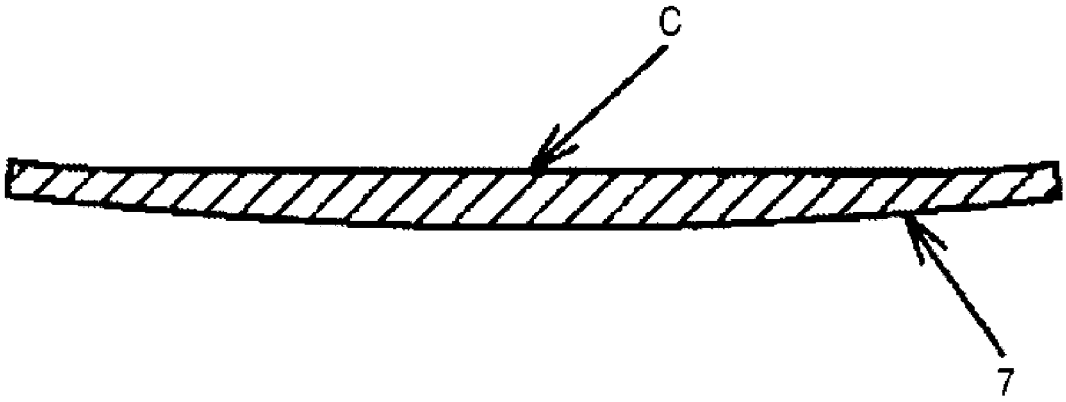
FIG. 4 is a sectional view taken along the line B-B in FIG. 2.

FIG. 3 is a sectional view of the insert portion 7 taken along the line A-A in FIG. 2, and the insert portion 7 is formed such that the thickness of the central portion C becomes thickest (in the embodiment, 3.7 mm), while the thickness is reduced to a thinnest value towards the upper edge 7A and the lower edge 7B. FIG. 4 is a sectional view of the insert portion 7 taken along the line B-B in FIG. 2, and similarly, the insert portion 7 is formed such that the thickness of the central portion C becomes thickest, while the thickness at both sides become thinnest. In FIG. 4, a convex bulge of R250 to R800 is formed on a striking surface of the insert portion 7, and an angular thick portion 8 is formed on an opposite surface of the insert portion 7 to the striking surface. Note that both the case where the thickness of the thin portion along the outer circumferential line of the thick portion 8 is made to be 2.5 mm and the case where the thickness of the face portion outside the thick portion 8 which lies adjacent to that thin portion is made also to be 2.5 mm are understood to be included in the expression, "the face portion outside the thick portion 8 is formed thinner than the thickness of the thick portion 8."

Figure 5:
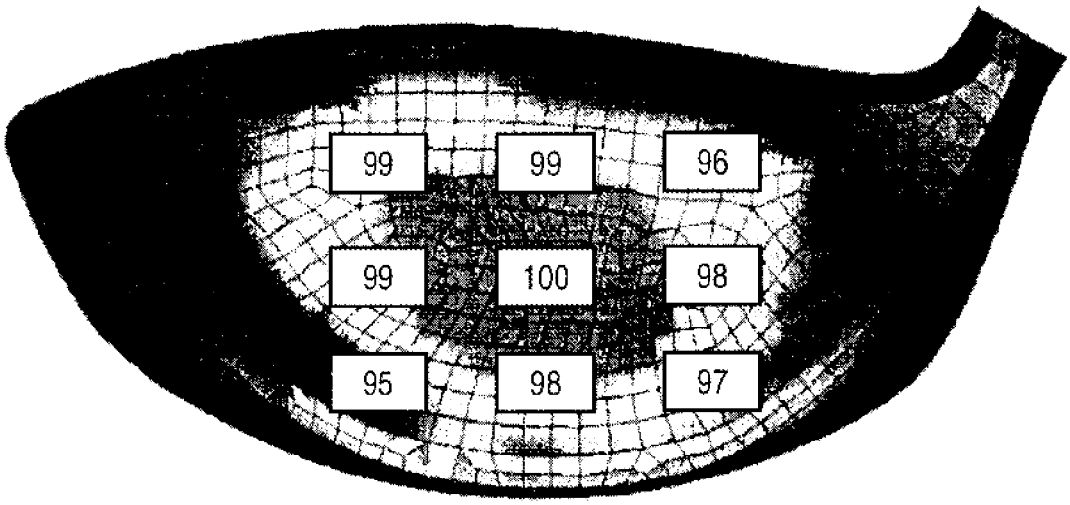
FIG. 5 is a diagram showing initial speeds of balls when hit at respective portions on the face of the head of the invention.

FIG. 5 shows initial speeds of balls hit at off-center portions of the head of the golf club shown in FIG. 1 which is made of the titanium alloy and which has the hollow portion therein when a golfer whose head speed is 45 m/s hit the balls using the golf club in relation to an initial speed, represented as 100, of a ball hit at the center of the face of the same golf club head by the same golfer. With the head of the invention, the results were "97" in a lower portion close to the heel, "98" in an intermediate portion close to the heel, "96" in an upper portion close to the heel, "95" in a lower portion close to the toe, "99" in an intermediate portion close to the toe, and "99" in an upper portion close to the toe, and no remarkable reduction in initial speed was observed. Initial speeds of "99" and "98" were obtained in longitudinally central upper and lower portions.

Figure 6:
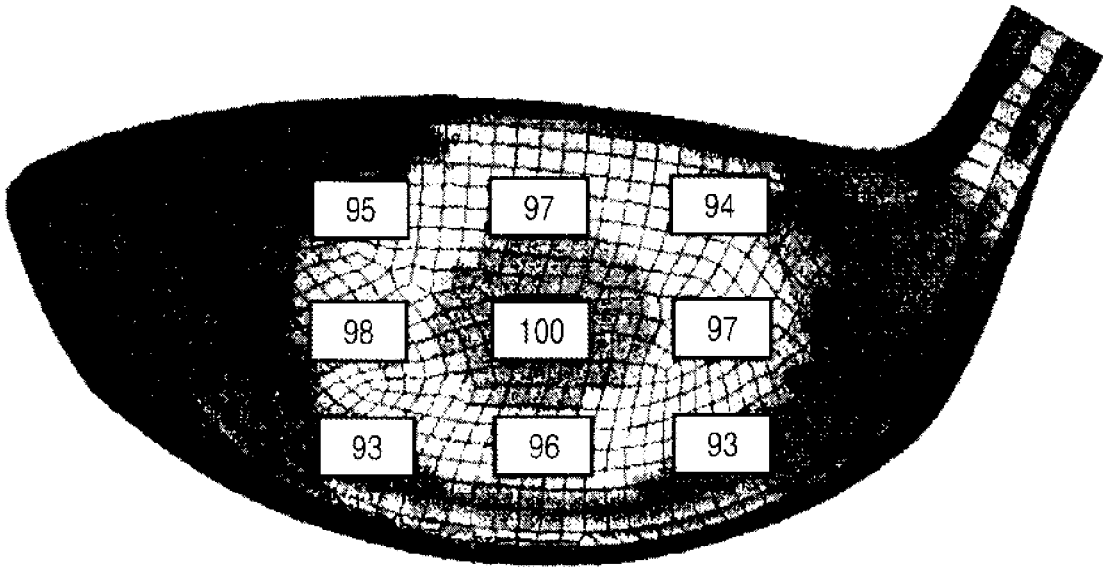
FIG. 6 is a diagram showing initial speeds of balls when hit at respective portions on a face of a conventional head.

FIG. 6 shows the results of an experiment on initial speeds of balls hit using a head made such that an oval thick portion with a major axis of 60 mm and a minor axis of 40 mm was formed in the center of a face in such a manner that the major axis became horizontal and the thickness of the center of the thick portion was 3.7 mm, while the thickness of the periphery thereof was 2.5 mm. The head speed was 45 m/s, and the head used had the same volume as that of the head shown in FIG. 5. The resulting initial speeds were "95" in a toe upper portion (while "99" in the invention) and "93" in a heel lower portion (while "97" in the invention), and it is seen from the results that the initial speeds of the balls hit at the off-center portions of the head were reduced largely.

Note that while the invention has been described as being applied to the golf club head of the driver which is the wood club, the invention can also be applied to heads of fairway woods or utility clubs (hybrid clubs).

According to the embodiment, since the center of the oval thick portion which has the recesses formed by recessing both the sides in the major axis direction in the arc-shaped fashion is positioned in the central portion of the ball-striking face of the face member of the head which is made of the metal material, the thick portion is formed on the face member in such a manner that the recesses are directed to the toe-side upper portion and the heel-side lower portion, respectively, the thickness of the thick portion is made such that the thickness becomes thickest at the central portion and is gradually reduced from the central portion towards the periphery of the thick portion, the portion of the face which lies outside the thick portion is formed thinner than the thick portion, and the occupancy rate of the thick portion in the face is made to be in the range of 25 to 45%, when balls hit the toe-side upper portion and the heel-side lower portion on both of which scattered striking points by amateur golfers tend to be collected, the balls gather at the thin portion (2.5 mm or less) of the toe-side upper portion and the thin portion (2.5 mm or less) of the heel-side lower portion due to the two recesses being formed in the thick portion, whereby the balls can be hit without their initial speeds being reduced so much. Namely, when the balls are hit at the toe-side upper portion and the heel-side lower portion which both lie outside the recesses, the springing effect is produced, whereby the reduction in their initial speeds is prevented. Although there has been conventionally known the technique in which the reduction in speed of a ball resulting from an off-center shot is mitigated by making the thickness at the center of the face thicker than that of the periphery of the face of the face member, it is the invention which realizes the minimization of reduction in speed of a ball resulting from an off-center shot while maximizing the speed of the ball hit at the center of the face by studying and devising the degree of thickness and range of the central thick portion and the degree of thickness and range of the peripheral thin portion.

What is claimed is:

1. A golf club head, comprising:

a face member made of a metal material;

wherein the face member includes a ball-striking face, and an oval thick portion positioned in a central portion of the ball-striking face;

the oval thick portion has an oval shape viewed in a direction crossing the ball-striking face, the oval shape having recesses formed by recessing both sides of the oval shape in a major axis direction thereof along the face member in an arc-shaped fashion;

the oval thick portion is formed on the face member such that the recesses are directed to a toe-side upper portion and a heel-side lower portion, respectively;

the oval thick portion has a thickness that becomes thickest at a central portion of the oval thick portion and is gradually reduced from the central portion towards a periphery of the oval thick portion;

the face member is formed such that a portion which lies outside the thick portion is thinner than the oval thick portion; and an occupancy rate of the oval thick portion in the ball-striking face is in a range of 25 to 45%, wherein an occupancy rate of the toe-side upper portion and the heel-side lower portion in a portion of the ball-striking face which excludes the oval thick portion is 60% or more.

2. The golf club head as claimed in claim 1, wherein a thickness of the face member excluding the thick portion is 2.5 mm or less.

3. The golf club head as claimed in claim 1, wherein the recesses in the oval thick portion viewed in the direction crossing the ball-striking face are concave relative to a location outside of the oval thick portion.

4. The golf club head of claim 1, wherein an inclination of the major axis of the oval thick portion is in a range from 10° to 30° from a horizontal line tangent to a sole of the golf club head.

5. The golf club head as claimed in claim 1, wherein a radius of curvature of the recesses is from 12 mm to 25 mm; and a radius of curvature of arcs of crown and sole sides of the oval thick portion is from 35 mm to 60 mm.

6. The golf club head according to claim 1, wherein a ratio of a major axis, and a minor axis of the oval shape is in a range of 5:4 to 5:6.

7. A golf club head, comprising:

a face member made of a metal material;

wherein the face member includes a ball-striking face, and an oval thick portion positioned in a central portion of the ball-striking face;

the oval thick portion has an oval shape viewed in a direction crossing the ball-striking face, the oval shape having recesses formed by recessing both sides in a major axis direction in an arc-shaped fashion;

the oval thick portion is formed on the face member such that the recesses are directed to a toe-side upper portion and a heel-side lower portion, respectively;

the oval thick portion has a thickness that becomes thickest at a central portion of the oval thick portion and is gradually reduced from the central portion towards a periphery of the oval thick portion;

the face member is formed such that a portion which lies outside the thick portion is thinner than the oval thick portion; and an occupancy rate of the oval thick portion in the ball-striking face is in a range of 25 to 45%, wherein the recesses in the oval thick portion viewed in the direction crossing the ball-striking face are concave relative to a location outside of the oval thick portion.

8. The golf club head as claimed in claim 7, wherein an occupancy rate of the toe-side upper portion and the heel-side lower portion in a portion of the ball-striking face which excludes the oval thick portion is 60% or more.

9. The golf club head as claimed in claim 7, wherein a thickness of the face member excluding the thick portion is 2.5 mm or less.

10. The golf club head of claim 7, wherein an inclination of the major axis of the oval thick portion is in a range from 10° to 30° from a horizontal line tangent to a sole of the golf club head.

11. The golf club head according to claim 7, wherein a ratio of a major axis and a minor axis of the oval shape is in a range of 5:4 to 5:6.

12. A golf club head, comprising:

a face member made of a metal material;

wherein the face member includes a ball-striking face, and an oval thick portion positioned in a central portion of the ball-striking face;

the oval thick portion has an oval shape viewed in a direction crossing the ball-striking face, the oval shape having recesses formed by recessing both sides in a major axis direction in an arc-shaped fashion;

the oval thick portion is formed on the face member such that the recesses are directed to a toe-side upper portion and a heel-side lower portion, respectively;

the oval thick portion has a thickness that becomes thickest at a central portion of the oval thick portion and is gradually reduced from the central portion towards a periphery of the oval thick portion;

the face member is formed such that a portion which lies outside the thick portion is thinner than the oval thick portion; and an occupancy rate of the oval thick portion in the ball-striking face is in a range of 25 to 45%, wherein a radius of curvature of the recesses is from 12 mm to 25 mm; and a radius of curvature of arcs of crown and sole sides of the oval thick portion is from 35 mm to 60 mm.

13. The golf club head as claimed in claim 12, wherein an occupancy rate of the toe-side upper portion and the heel-side lower portion in a portion of the ball-striking face which excludes the oval thick portion is 60% or more.

14. The golf club head as claimed in claim 12, wherein a thickness of the face member excluding the thick portion is 2.5 mm or less.

15. The golf club head as claimed in claim 12, wherein the recesses in the oval thick portion viewed in the direction crossing the ball-striking face are concave relative to a location outside of the oval thick portion.

16. The golf club head of claim 12, wherein an inclination of the major axis of the oval thick portion is in a range from 10° to 30° from a horizontal line tangent to a sole of the golf club head.

17. The golf club head according to claim 12, wherein a ratio of a major axis and a minor axis of the oval shape is in a range of 5:4 to 5:6.

* * * * *